US007129639B2

(12) United States Patent
Kim et al.

(10) Patent No.: US 7,129,639 B2
(45) Date of Patent: Oct. 31, 2006

(54) MIDDLE OUTPUT ELECTRODELESS LIGHTING SYSTEM

(75) Inventors: Hyun-Jung Kim, Seoul (KR); Joon-Sik Choi, Seoul (KR); Yun-Chul Jung, Gyeonggi-Do (KR); Yong-Seog Jeon, Gyeonggi-Do (KR); Seung-Yeup Hyun, Seoul (KR); Byeong-Ju Park, Seoul (KR); Ri-Na Hwang, Seoul (KR); Dae-Kyung Kim, Seoul (KR); Ji-Young Lee, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/037,016

(22) Filed: Jan. 19, 2005

(65) Prior Publication Data

US 2006/0076902 A1 Apr. 13, 2006

(30) Foreign Application Priority Data

Sep. 25, 2004 (KR) ..... 10-2004-0077651

(51) Int. Cl.
*H05B 41/16* (2006.01)

(52) U.S. Cl. ..... 315/39; 315/248; 313/484

(58) Field of Classification Search ..... None
See application file for complete search history.

(56) References Cited

U.S. PATENT DOCUMENTS

| | | | | |
|---|---|---|---|---|
| 3,431,461 | A | 3/1969 | Dodo et al. | |
| 3,911,318 | A | 10/1975 | Spero et al. | |
| 7,081,636 | B1 | 7/2006 | Moruzzi | |
| 2002/0167282 | A1* | 11/2002 | Kirkpatrick et al. | 315/248 |
| 2004/0120147 | A1 | 6/2004 | Jeon et al. | 362/260 |

FOREIGN PATENT DOCUMENTS

| | | | |
|---|---|---|---|
| JP | 61-208743 | | 9/1986 |
| JP | 61-240562 | | 10/1986 |
| JP | 7-183008 | | 7/1995 |
| JP | 11-102795 | | 4/1999 |
| JP | 02001210278 A | * | 8/2001 |
| WO | 03/021632 | | 3/2003 |

OTHER PUBLICATIONS

U.S. Appl. No. 11/029,373 to Choi et al., which was filed on Jan. 6, 2005.
U.S. Appl. No. 11/029,421 to Park et al., which was filed on Jan. 6, 2005.
English language abstract of JP 11-102795.

* cited by examiner

*Primary Examiner*—David Vu
(74) *Attorney, Agent, or Firm*—Greenblum & Bernstein, P.L.C.

(57) ABSTRACT

An electrodeless lighting system includes a resonator which passes light. The resonator communicates with a waveguide which guides microwave energy generated by a microwave generator. The microwave energy forms an electric field in the resonator. The electrodeless lighting system further includes a bulb, positioned in the resonator, that generates light from the electric field, a first coil which is wound around an outer circumferential surface of the resonator, and a second coil which is wound around the outer circumferential surface of the resonator. The bulb is disposed between the first coil and the second coil, with the first coil and the second coil forming a magnetic field around the bulb. Accordingly, initial lighting can be more easily achieved, and if the intensity of the magnetic field is properly controlled, the total quantity of light is increased, thereby improving luminous efficiency of the bulb.

5 Claims, 3 Drawing Sheets

MIDDLE OUTPUT ELECTRODELESS LIGHTING SYSTEM

BACKGROUND OF THE INVENTION

1. Field of the Invention

The present invention relates to an electrodeless lighting system, and particularly, to a middle output electrodeless lighting system configured to apply a magnetic field to an electrodeless bulb to improve luminous efficiency.

2. Description of the Background Art

In general, an electrodeless lighting system is an apparatus emitting visible light or ultraviolet light from an electrodeless plasma bulb upon applying microwave energy to the bulb. The electrodeless lighting system has a long life span and good lighting effect compared with an incandescent lamp or a fluorescent lamp which is generally used.

Such an electrodeless lighting system is classified into high output, middle output and low output according to its usage and output extent.

FIG. 1 is a longitudinal sectional view showing one example of a conventional middle output electrodeless lighting system.

As shown, the conventional middle output electrodeless lighting system using microwave energy comprises: a case 1 forming a certain internal space; a microwave generator 2 mounted in the case 1, for generating microwave energy; a high voltage generator 3 raising common AC power to a high voltage and supplying the high voltage to the microwave generator 2; a waveguide 4 for guiding microwave energy generated at the microwave generator 2; a resonator 6 installed at an exit portion 4*a* of the waveguide 4, communicating with the waveguide 4; and a bulb 5 positioned in the resonator 6, for generating light as a filling material becomes a plasma by the microwave energy transferred through the waveguide 4.

In addition, a reflecting mirror 7 for concentratively reflecting light generated at the bulb 5 to the front is provided in front of the case 1, namely, at a peripheral area of the resonator 6.

A dielectric mirror 8 which passes microwave energy transferred through the waveguide 4 and reflects light emitted from the bulb 5 to the front is installed in the exit portion 4*a* of the waveguide 4. A hole 8*a* is formed at a central portion of the dielectric mirror 8, so that a shaft portion 9 of the bulb 5 penetrates therethrough.

Meanwhile, a cooling fan 10 for cooling the microwave generator 2 and the high voltage generator 3 is provided at the rear of the case 1. And, non-explained reference numeral 11 is a fan motor, and 12 is a bulb motor for rotating the bulb 5.

The conventional middle output electrodeless lighting system having such a structure is operated in the following manner.

When a driving signal is inputted to the high voltage generator 3, the high voltage generator 3 raises AC power and supplies a raised high voltage to the microwave generator 2, and the microwave generator 2 is oscillated by the high voltage, thereby generating microwave energy having a very high frequency. The microwave energy generated in such a manner is guided through the waveguide 4 and is emitted into the resonator 6. The emitted microwave energy resonates in the resonator 6, forming an electric field and strongly being applied to a portion where the bulb 5 of the resonator 6 is placed. At this time, a filling material within the bulb 5 is electrically discharged, thereby generating light having a specific spectrum. This light is reflected to the front by the reflecting mirror 7 and the dielectric mirror, thereby lightening a space.

However, the conventional middle output electrodeless lighting system constructed as above uses a bulb having a volume of about 50% of a volume of a bulb used for a high output electrodeless lighting system. Since the volume of the bulb of the middle output electrodeless lighting system is smaller than that of the high output one, the amount of a filling material filled therein is also decreased. Accordingly, initial lighting is not easily achieved, and thus luminous efficiency of the entire electrodeless lighting system is degraded.

SUMMARY OF THE INVENTION

Therefore, an object of the present invention is to provide a middle output electrodeless lighting system configured to apply a magnetic field to an electrodeless bulb to improve luminous efficiency.

To achieve these and other advantages and in accordance with the purpose of the present invention, as embodied and broadly described herein, there is provided a middle output electrodeless lighting system comprising: a resonator communicating with a waveguide for guiding microwave energy generated at a microwave generator, the resonator passing light, in which an electric field is formed by microwave energy; a bulb positioned in the resonator, for generating light by microwave energy by the electric field; and a magnetic field applying means installed around the resonator to improve luminous efficiency of the bulb, for forming a magnetic field around the bulb.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a middle output electrodeless lighting system in accordance with the present invention, and hereinafter, the most preferred embodiment will be explained.

Figure 1:
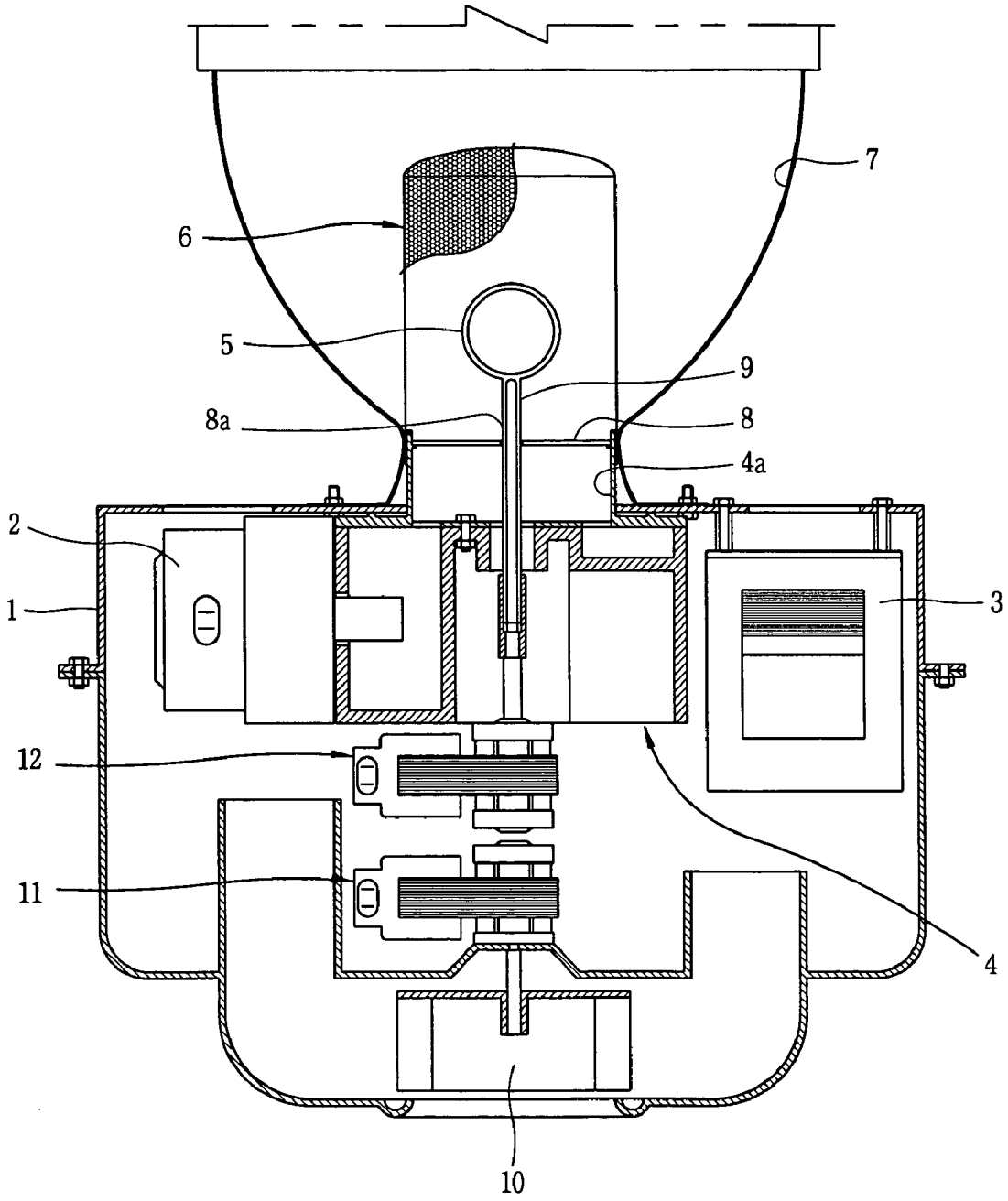
FIG. 1 CONVENTIONAL ART
FIG. 1 is a sectional view showing a structure of a conventional middle output electrodeless lighting system.
Figure 2:
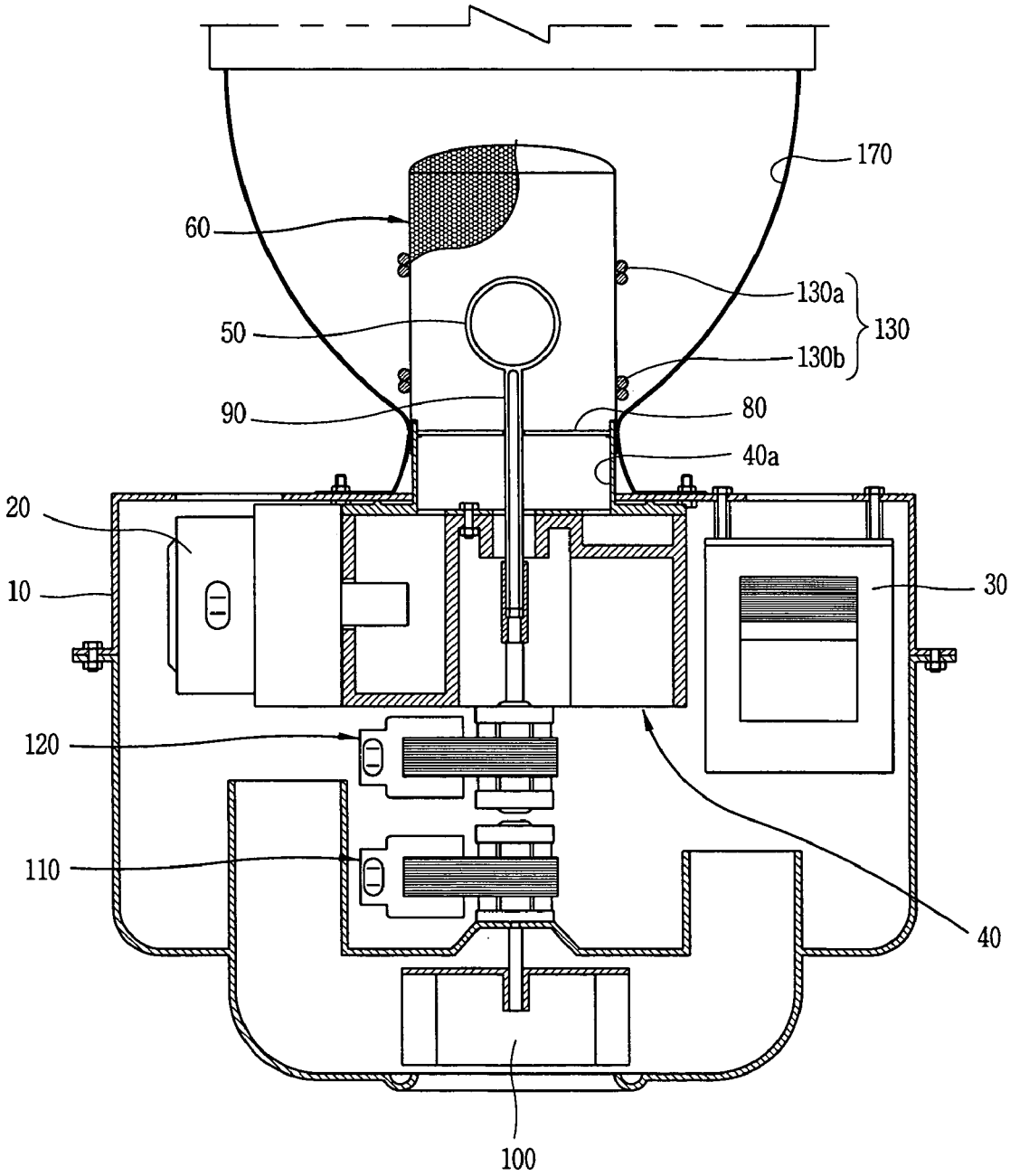
FIG. 2 is a sectional view showing a structure of a -middle output electrodeless lighting system in accordance -with one embodiment of the present invention.
Figure 3:
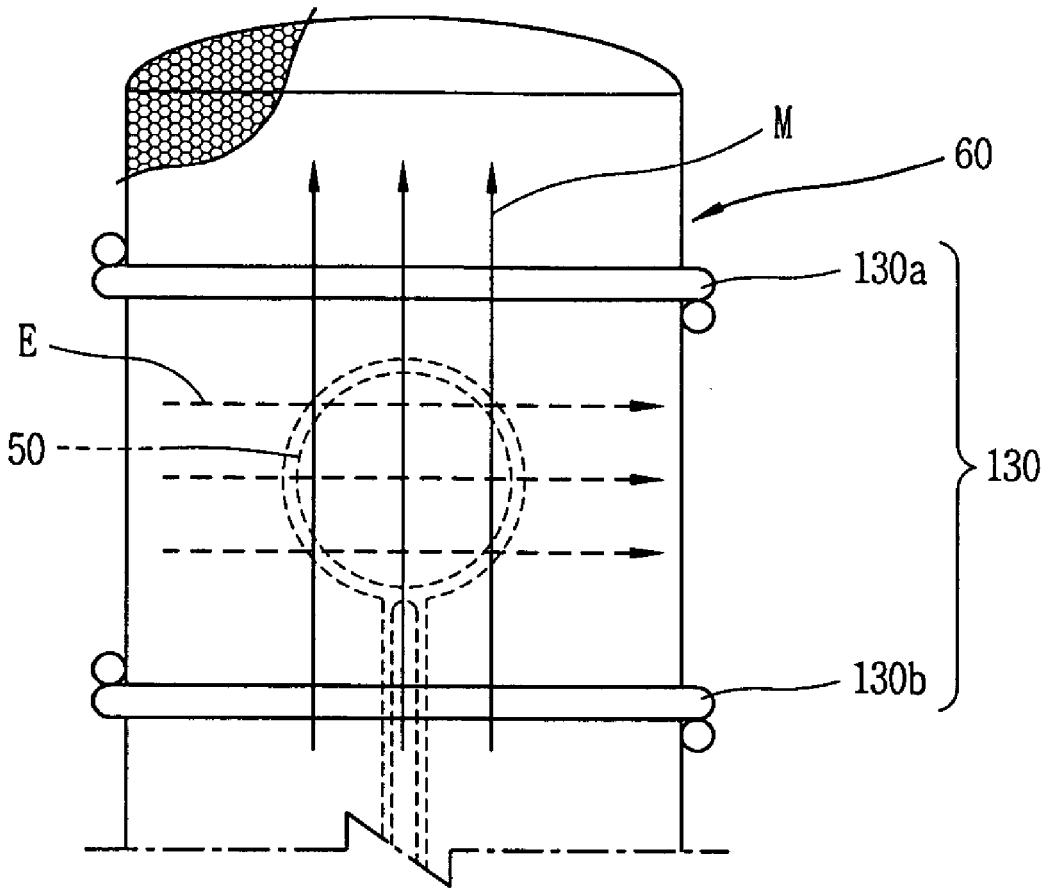
FIG. 3 is a front view showing a structure of a resonator provided with a magnetic field applying means in accordance with one embodiment of the present invention.

FIG. 2 is a sectional view showing a structure of an electrodeless lighting system in accordance with one embodiment of the present invention, and FIG. 3 is a front view showing a structure of a resonator provided with a magnetic field applying means in accordance with one embodiment of the present invention.

As shown, the middle output electrodeless lighting system in accordance with one embodiment of the present invention comprises: a case 10 forming a certain internal space; a microwave generator 30 mounted in the case 10, for generating microwave energy; a high voltage generator 30 raising common AC power to a high voltage and supplying the high voltage to the microwave generator 20; a waveguide 40 for guiding microwave energy generated at the microwave generator 20; a resonator 60 installed at an exit portion 40*a* of the waveguide 40, communicating with the waveguide 40, the resonator 60 passing light, in which an electric field is formed by microwave wave; a bulb 50 positioned in the resonator 60, for generating light as a filling material becomes a plasma by microwave energy transferred through the-waveguide 40; and a magnetic field applying means 130 installed around the resonator 60 to improve luminous efficiency of the bulb 50, for forming a magnetic field around the bulb 50.

In addition, a reflecting mirror 170 for concentratively reflecting light, which has been generated from the bulb 50, to the front is provided in front of the case 10, namely at a peripheral area of the resonator 60.

A dielectric mirror 80 which passes microwave energy transferred through the waveguide 40 and reflects light emitted from the bulb 50 to the front is installed in the exit portion 40*a* of the waveguide 40. And a hole is formed at a central portion of the dielectric mirror 80, so that a shaft portion 90 of the bulb 50 penetrates therethrough.

Meanwhile, a cooling fan 100 for cooling the microwave generator 20 and the high voltage generator 30 is provided at the rear of the case 10. And, non-explained reference numeral 110 is a fan motor, and 120 is a bulb motor for rotating the bulb 50.

The magnetic field applying means 130 is installed parallel to a direction (E) of an electric field formed in the resonator 60, so that a magnetic field can be formed in a direction (M) perpendicular to the direction (E) of the electric field.

Namely, the magnetic field applying means 130 is wound as a coil shape around an outer circumferential surface of the resonator 60 formed in a cylindrical or many-sided shape, parallel to a direction (E) of the electric field.

As shown in FIG. 3 in detail, the magnetic field applying means 130 preferably includes: a first coil 130*a* wound around an outer circumferential surface of the resonator 60; and a second coil 130*b* wound around the outer circumferential surface of the resonator 60 and disposed at a certain distance from the first coil 130*a*, having the bulb 50 therebetween, for forming a magnetic field around the bulb 50 through interaction with the first coil 130*a*.

Namely, intensity of a magnetic field is determined according to the number of winding of the first coil 130*a* and the second coil 130*b* and the intensity of a current flowing through the first and second coils 130*a* and 130*b* in order to improve luminous efficiency of the bulb 50 together with an electric field formed in the resonator 60.

Preferably, a Helmholtz coil in which a radius of each of the first and second coils is the same as a distance between the first coil 130*a* and the second coil 130*b* is used for the magnetic field applying means 130, and by using such a coil, luminous efficiency of the bulb 50 is increased.

Meanwhile, preferably, an AC current is applied to the first coil 130*a* and the second coil 130*b*, thereby changing a direction of a generated magnetic field, so that it can be accelerated that a filling material within the bulb 60 becomes a plasma.

Also, although not shown in the drawing, as another example of the magnetic field applying means 130 in accordance with the present invention, a solenoid formed on an outer circumferential surface of the resonator 60 in its longitudinal direction may be employed. At this time, the construction should made, not interfering a path of light emitted from the bulb to the outside.

Hereinafter, the operation of the middle output electrodeless lighting system in accordance with one embodiment of the present invention will now be described.

When a driving signal is inputted to the high voltage generator 30, the high voltage generator 30 raises AC power and supplies the raised high voltage to the microwave generator 20, and the microwave generator 20 is oscillated by the high voltage, generating microwave energy having a very high frequency. The microwave energy generated in such a manner is guided through the waveguide 40 and is emitted into the resonator 60. The microwave, energy emitted into the resonator 60 forms an electric field in the resonator 60, resonating and being strongly applied to a portion where the bulb 50 of the resonator 60 is placed. At the same time, when an AC current is applied to the magnetic field applying means 130 mounted at an outer circumferential surface of the resonator 60, namely, to the first coil 130*a* and the second coil 130*b*, a magnetic field (M) alternately changed in a direction perpendicular to the direction (E) of the electric field is formed at central portions of the first and second coils 130*a* and 130*b*. By interaction between the magnetic field (M) and the electric field (E), a filling material within the bulb 5 is easily electrically discharged, thereby generating light having a specific spectrum. The light is reflected to the front by the reflecting mirror 7 and the dielectric mirror 80, thereby lightening a space.

As so far described, in the middle output electrodeless lighting-system in accordance with the present invention, as the magnetic field applying means mounted at an outer circumferential surface of the resonator forms a magnetic field in the resonator, the magnetic field interacts with the electric field formed by microwave energy. Through the interaction, initial lighting of the middle output electrodeless lighting system which employs a bulb having a volume smaller than that of a bulb of a high output electrodeless lighting system by half can be more easily achieved.

Also, if intensity of an electric field transferred into the resonator and of a magnetic field generated by the magnetic field applying means is properly adjusted, the total quantity of light is increased, thereby greatly improving luminous efficiency.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system, comprising:

a resonator which passes light, the resonator communicating with a waveguide which guides microwave energy generated by a microwave generator, the microwave energy forming an electric field in the resonator;

a bulb, positioned in the resonator, that generates light from the electric field;

a first coil wound around an outer circumferential surface of the resonator; and a second coil wound around an outer circumferential surface of the resonator, the bulb being disposed between the first coil and the second coil, the first coil and the second coil forming a magnetic field around the bulb.

2. The lighting system of claim 1, wherein the first coil and the second coil are wound in a direction parallel to a direction of the electric field formed in the resonator, such that the magnetic field is formed in a direction perpendicular to the direction of the electric field.

3. The lighting system of claim 1, wherein the first coil and the second coil comprise a Helmholtz coil.

4. The lighting system of claim 1, wherein an AC current is applied to the first coil and the second coil.

5. The lighting system of claim 1, wherein a radiating area of light generated by said bulb is increased by disposing said first coil from said second coil by a predetermined distance.

* * * * *

UNITED STATES PATENT AND TRADEMARK OFFICE

CERTIFICATE OF CORRECTION

PATENT NO. : 7,129,639 B2
APPLICATION NO. : 11/037016
DATED : October 31, 2006
INVENTOR(S) : Kim et al.

It is certified that error appears in the above-identified patent and that said Letters Patent is hereby corrected as shown below:

Title Page;

On the cover of the printed patent, at Item (56) OTHER PUBLICATIONS, add
--English Language Abstract of JP 61-240562
English Language Abstract of JP 2001-210278
English Language Abstract of JP 7-183008
English Language Abstract of JP61-208743--.

Signed and Sealed this

Twenty-fifth Day of March, 2008

JON W. DUDAS
*Director of the United States Patent and Trademark Office*